US006777608B1

(12) United States Patent
Redding

(10) Patent No.: US 6,777,608 B1
(45) Date of Patent: Aug. 17, 2004

(54) INTEGRATED SOUND TRIGGER MUSICAL INSTRUMENTS

(76) Inventor: Travis Redding, 12307 Roxie Dr., Suite 218, Austin, TX (US) 78729

( * ) Notice: Subject to any disclaimer, the term of this patent is extended or adjusted under 35 U.S.C. 154(b) by 0 days.

(21) Appl. No.: 10/340,909

(22) Filed: Jan. 11, 2003

Related U.S. Application Data

(60) Provisional application No. 60/347,957, filed on Jan. 12, 2002.

(51) Int. Cl.[7] ..... G10H 1/32; G10H 3/00

(52) U.S. Cl. ..... 84/746

(58) Field of Search ..... 84/722, 743, 745

(56) References Cited

U.S. PATENT DOCUMENTS

| | | | | | |
|---|---|---|---|---|---|
| 3,555,166 | A | | 1/1971 | Gasser | |
| 4,306,480 | A | | 12/1981 | Eventoff et al. | |
| 4,336,734 | A | | 6/1982 | Polson | |
| 4,339,979 | A | | 7/1982 | Norman | |
| 4,570,521 | A | | 2/1986 | Fox | |
| 4,794,838 | A | | 1/1989 | Corrigau | |
| 4,951,545 | A | | 8/1990 | Yoshida | |
| 5,024,134 | A | * | 6/1991 | Uchiyama | 84/654 |
| 5,040,447 | A | * | 8/1991 | Murata et al. | 84/612 |
| 5,065,659 | A | * | 11/1991 | Uchiyama et al. | 84/723 |
| 5,085,119 | A | | 2/1992 | Cole | |
| 5,121,668 | A | | 6/1992 | Segan et al. | |
| 5,140,887 | A | | 8/1992 | Chapman | |
| 5,227,575 | A | | 7/1993 | Mishima | |
| 5,380,948 | A | * | 1/1995 | Freimuth et al. | 84/8 |
| 5,398,585 | A | | 3/1995 | Starr | |
| 5,403,972 | A | * | 4/1995 | Valentine, Sr. | 84/730 |
| 5,777,251 | A | | 7/1998 | Hotta et al. | |
| 5,990,411 | A | | 11/1999 | Kellar | |
| 6,018,119 | A | | 1/2000 | Mladek | |
| 6,479,741 | B1 | | 11/2002 | Morton et al. | |

* cited by examiner

*Primary Examiner*—Jeffery W Donels
(74) *Attorney, Agent, or Firm*—Charles Saron Knobloch

(57) ABSTRACT

A stringed musical instrument with integrated sound triggers allowing for the simultaneous production, when played, of acoustic and electric signals and beats within a single time movement. The player operates the instrument of the present invention by pressing one or more strings 90 down unto fret board 60. Pickup 110 converts the vibrating strings 90 of the fretted note to a signal, which is sent via wiring 150 to port 170. Coinciding with the location of the players pressing, one or more trigger pads (fret trigger pad 50, finger trigger pad 70, percussion trigger pad 80) sends a signal via wiring 150 to port 170. During the time movement, the player can combine the above action with further action by the player's other hand. Anywhere between the fretted note and bridge 120, strings 90 may be struck, strummed, slapped, popped, picked, or played with a bow. The player will find that each method will create different overall sounds. Depending how and where the strings 90 are played with the other hand, the player can strike a second trigger pad (fret trigger pad 50, finger trigger pad 70, percussion trigger pad 80), typically on the lower portion of fret board 60. This causes a third event within the time movement, which is a second trigger signal. With this ability, the player then can create compositions integrating many movements with a plurality of signals per time movement. Using current outboard technology, the player is able to assign one of thousands of sounds to each of the strings 90 and each of the trigger pads (fret trigger pad 50, finger trigger pad 70, percussion trigger pad 80).

35 Claims, 6 Drawing Sheets

INTEGRATED SOUND TRIGGER MUSICAL INSTRUMENTS

REFERENCE

Pursuant to 35 U.S.C. 119(e)(1), reference is hereby made to earlier filed provisional Patent Application No. 60/347,957 to Travis Redding for Integrated Sound Trigger Musical Instruments of filing date Jan. 12th, 2002.

FIELD OF THE INVENTION

This invention relates to musical instruments, specifically to such musical instruments that incorporate sound trigger technology to generate multiple simultaneous tones and beats within a single time movement when played.

BACKGROUND OF THE INVENTION

Modern electric musical instruments produce a vibration when a string or a sound trigger is strummed, plucked, struck, or otherwise played. A string vibration is sensed by an electric pickup, which converts the vibration to a signal. When a sound trigger senses pressure it also produces a signal. This signal is sent to a modulating amplifier that produces a sound. A stringed instrument player alters the pitch of the sound by pressing the string down onto the playing surface, called a fret board, thereby changing the length of the vibrating portion of the string For every different position on the fret board called a fret, there is a separate string length or indication of pitch. A limitation of prior electric musical instruments is that a single string can only make a single sound within a single movement of time. Even with the use of multiple pickups sending separate signals, they are not independent because they are sensing the same vibration.

U.S. Pat. No. 5,140,887 to Chapman teaches a fret board and neck design having string like ridges over a sensor board. This design fuses the strings and the fret board surface to make a series of buttons that feel like strings. Each point of contact between the playing surface and the fingertip makes a single signal for a sound. In order to play multiple sounds the player must make contact with multiple playing surface to points. Chapman does not teach a method to integrate true string vibrations with signaling means, which would render an efficient method for incorporation into traditional guitar playing.

U.S. Pat. No. 5,085,119 to Cole teaches an instrument with no strings, using strum sensitive triggers to simulate string sound. Pitch is determined through many push buttons in the fret board. Cole teaches several features of the sensors to provide control over pitch bend and other sound manipulation. Cole teaches away from use of strings for the generation of actual string sound. The performer can play only one sound by pressing or strumming a single pad.

U.S. Pat. No. 4,794,838 to Corrigan, III teaches an instrument having a guitar like body using keyboard keys to generate tone. The neck is tubular with slide levers that move to control the pitch of a tone. The instrument can not be played like a traditional guitar in that is has no strings to strum or pluck Corrigan, III does not teach a method to produce multiple simultaneous sounds within a single movement.

U.S. Pat. No. 5,990,411 to Kellar teaches an adaptation to a regular guitar. The apparatus adheres to the back of the neck to give the instrument a series of switches on back of said neck, which may be activated by the thumb. The Kellar apparatus requires a separate movement, extra dexterity, and the additional use of the thumb, which would otherwise be used as a reference anchor for the hand. The method of use of the present invention allows trigger actuation using the same finger movements as used to play a traditional guitar, while further offering the ability to produce simultaneous multiple sounds.

U.S. Pat. No. 5,398,585 to Starr teaches an instrument similar to Cole, with more advanced electronics that allow enhanced assignment of sounds to different buttons. The object of the present invention is not dependent of onboard electronics to produce fundamental new sound.

U.S. Pat. No. 5,777,251 to Hotta et al. teaches an instrument that has no strings and uses push buttons to trigger melodies and sounds, using buttons to activate and deactivate sounds and data storage to store melodies.

U.S. Pat. No. 5,227,575 to Mishima teaches an instrument that is played upright, has push buttons on the fret board and a cord that is pulled to generate a signal to produce a string tone sound. The player presses the fret button so the instrument can determine pitch. The invention is designed to simulate a cello played with a bow. The pulling of the cord displaces the ability to play the instrument with strings, and impairs the ability to be used as a hand held instrument worn with a strap. An object of the present invention is to have strings over buttons, allowing multiple simultaneous sounds with one movement as well as to maintain the capability to be manufactured and played as a hand held instrument.

U.S. Pat. No. 4,951,545 to Yoshida teaches an instrument that has strings as well finger board contacts, which are pressed to direct a microprocessor to simulate a particular pitch. The purpose of the finger board contacts is to determine the pitch of a tone, as well as slight variations in the fretting of the string, so as to be able to simulate vibrato effect. The vibration of the string itself is not used, rather the string actuates a switch to turn on a simulation of the string sound.

An object of the present invention is to allow fretting of the strings as in a traditional guitar, generating true acoustical signals from the strings. The player frets a note to shorten the string vibration and uses guitar pickups to amplify the true tone, including any true vibrato effect produced. Another object of the present invention is to use triggers to generate tone signals separate from the strings and to further allow for interface directly to internal or external MIDI tone generators, such as a MIDI drum machine.

U.S. Pat. No. 5,121,668 to Segan et al. teaches a guitar having separate push buttons and strings. The player strums the strings to produce simulated string tone and presses buttons to command the microprocessor to generate paticular tones. No part of the playing area has strings arranged over buttons. Since the strings do not produce sound through their natural vibration, rather by actuating a switch, there is no need to fret the strings to produce the desired pitch. The push buttons are used to control the desired pitch, rater than to generate a simultaneous different sounds to accompany the natural pitch of a fretted string.

U.S. Pat. No. 6,018,119 to Mladek teaches an instrument containing push buttons with no strings. The buttons are arranged similar to guitar frets and pushed to generate notes and chords.

SUMMARY OF THE INVENTION

This instrument of the present invention is a String Integrated Sound Trigger Module musical instrument containing electronic triggers within the playing surface of the strings. The integration of sound triggers with traditional strings enables a single player to simultaneously produce multiple melodies and beats in a musical composition. The inventors anticipated trademark for this invention is Zynth™ integrated sound trigger musical instrument.

BRIEF DESCRIPTION OF THE DRAWINGS

The present invention and its advantages will be better understood by referring to the following detailed description and the attached drawings in which.

REFERENCE NUMERALS IN DRAWINGS

| | | | |
|---|---|---|---|
| 10 | head stock | 20 | tuning machine bracket |
| 30 | tuning machine | 40 | nut |
| 50 | fret trigger pad | 60 | fret board |
| 70 | finger trigger pad | 80 | percussion trigger pad |
| 90 | string | 100 | body |
| 110 | pickup | 120 | bridge |
| 130 | neck | 140 | channel |
| 150 | wiring | 160 | compartment |
| 170 | port | | |

DETAILED DESCRIPTION OF THE PREFERRED EMBODIMENTS

While the invention will be described in connection with its preferred embodiments, it will be understood that the invention is not limited thereto. On the contrary, it is intended to cover all alternatives, modifications, and equivalents, which may be included within the spirit and scope of the invention, as defined by the appended claims.

Figure 1:
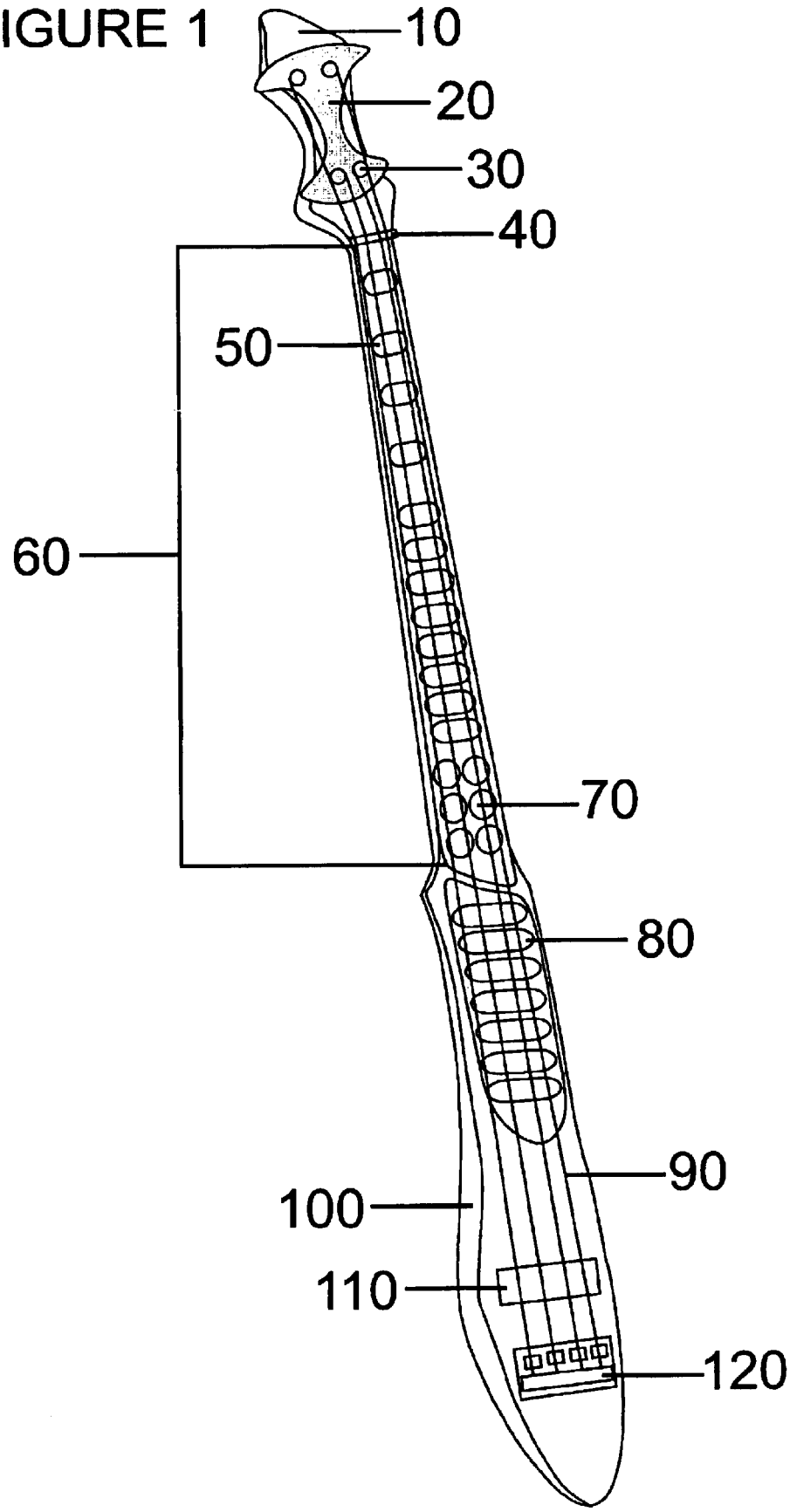
FIG. 1 illustrates a frontal perspective view of the musical instrument.
Figure 2:
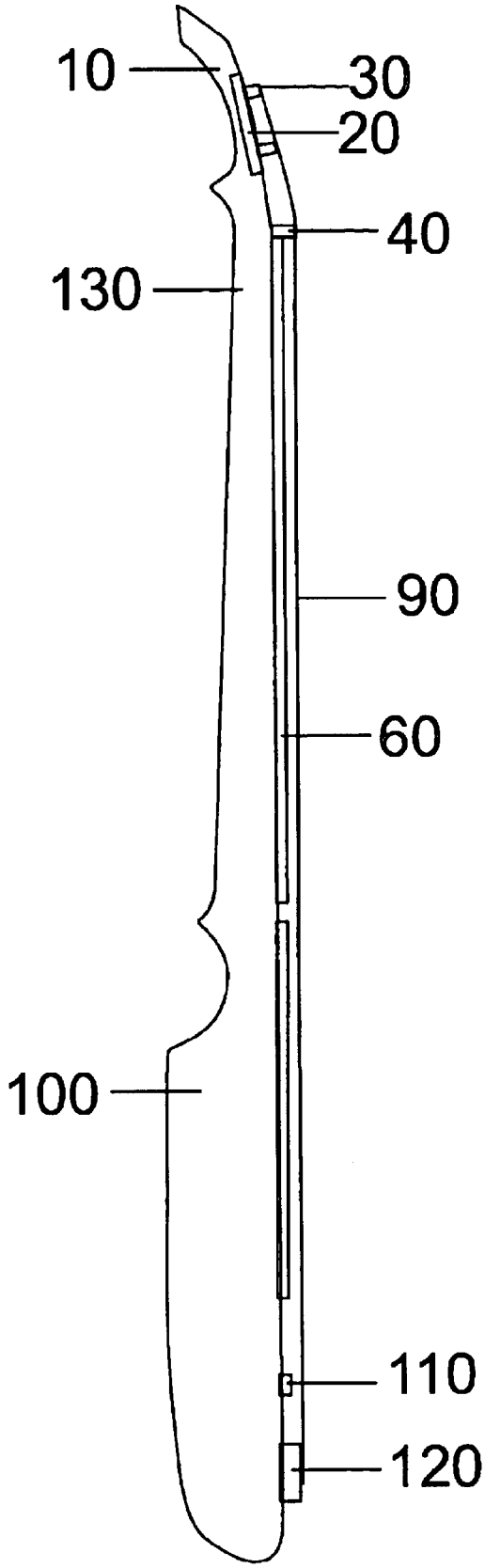
FIG. 2 illustrates a side view of the musical instrument.

A typical embodiment of the instrument of the present invention is illustrated in FIG. 1 (front view) and FIG. 2 (side view). The instrument has body 100 consisting of a material that remains adequately rigid relative to the vibrations induced to make music. One end of a neck 130 is firmly attached to one end of body 100. A head stock 10 is firmly attached to the opposite end of neck 130. In the preferred embodiment, the body 100, neck 130, and head stock 10 are firmly attached such that their combination remains adequately rigid relative to the vibrations induced to make music. The materials for the body 100, neck 130, and head stock 10 may be composed of any of a variety of materials, such as wood, metal, plastics, composites. Tuning machine bracket 20 attaches to the front of head stock 10. In the preferred embodiment, a plurality of tuning machines 30 attach to tuning machine bracket 20. Tuning machine 30 may also attach directly to head stock 10. A slotted guide, called a nut 40 attaches to the front of head stock 10. Fret board 60 attaches to the front of neck 130. A plurality of fret trigger pads 50 are affixed to fret board 60. A plurality of finger trigger pads 70 are affixed to fret board 60. A plurality of percussion trigger pads 80 are affixed to fret board 60. A pickup 110 is attached to the front of body 100. Bridge 120 is attached to the front of body 100. One end of a plurality of strings 90 are affixed to tuning machines 30. The opposite end of strings 90 are affixed to bridge 120. Strings 90 pass longitudinally along the front surface of fret board 60 and body 100, suspended over fret board 60 and body 100 by nut 40 and bridge 120. Bridge 120 is typically a piece of hardware that allows for adjustment in string height, intonation, and spacing.

Figure 3:
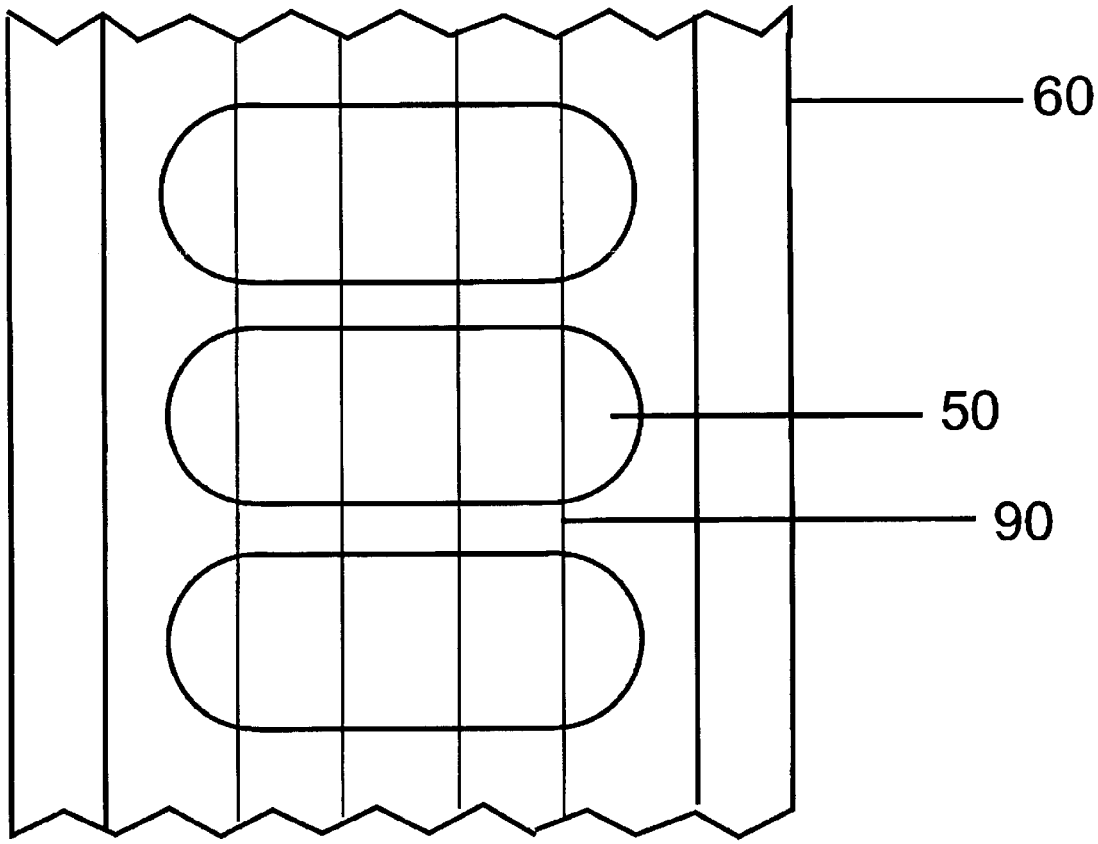
FIG. 3 illustrates a portion of the front view detailing the fret board, fret trigger pad, and strings.

FIG. 3 shows a portion of the front view of the present invention detailing the attachment of fret trigger pads 50 to fret board 60. Strings 90 pass over fret board 60 and fret trigger pads 50.

Figure 4:
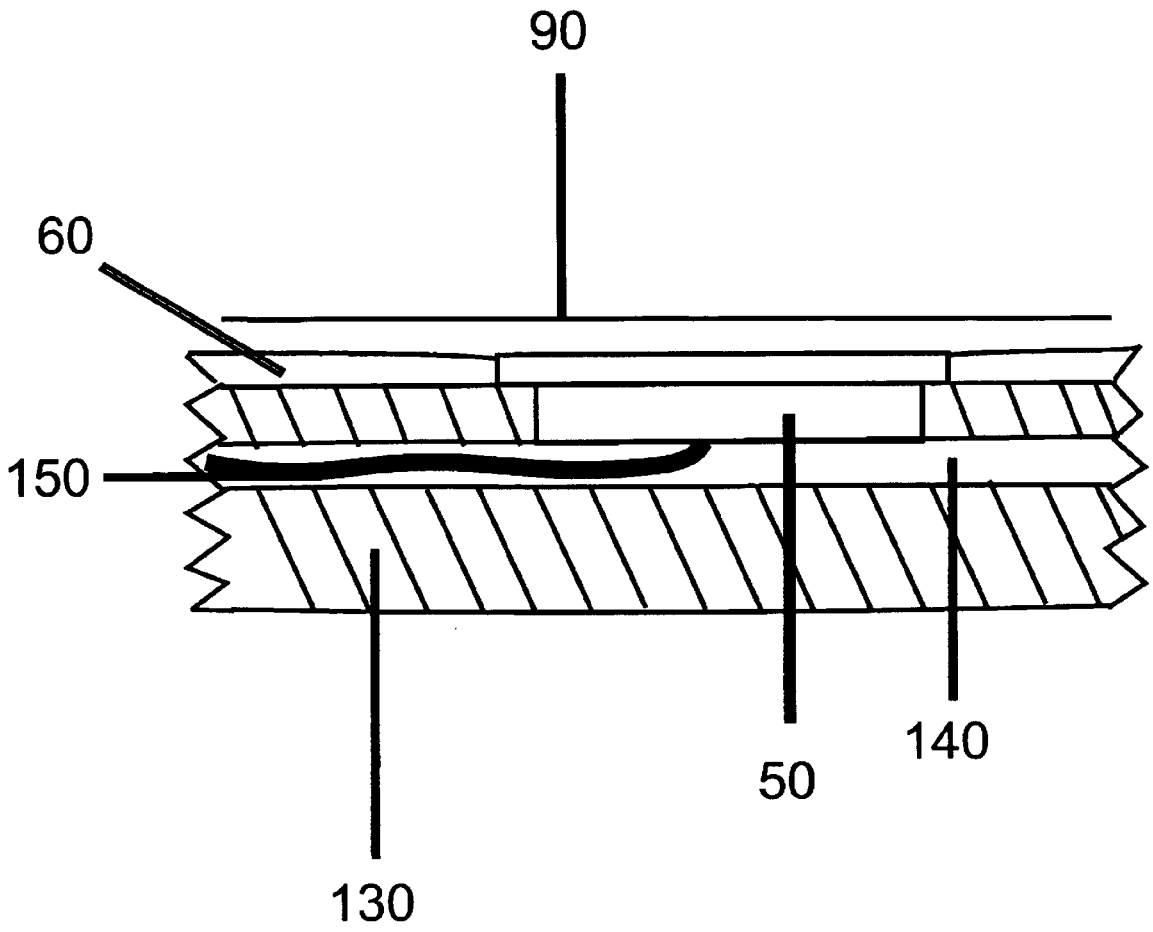
FIG. 4 illustrates a portion of the side view detailing the neck, fret board, fret trigger pad, and strings.

FIG. 4 shows a portion of the side view of neck 130. One end of wiring 150 connects to fret trigger pads 50. In a like manner, one end of wiring 150 connects to finger trigger pads 70 and percussion trigger pads 80. Channel 140 passes longitudinally across the front of neck 130. Wiring 150 is placed in channel 140.

Figure 5:
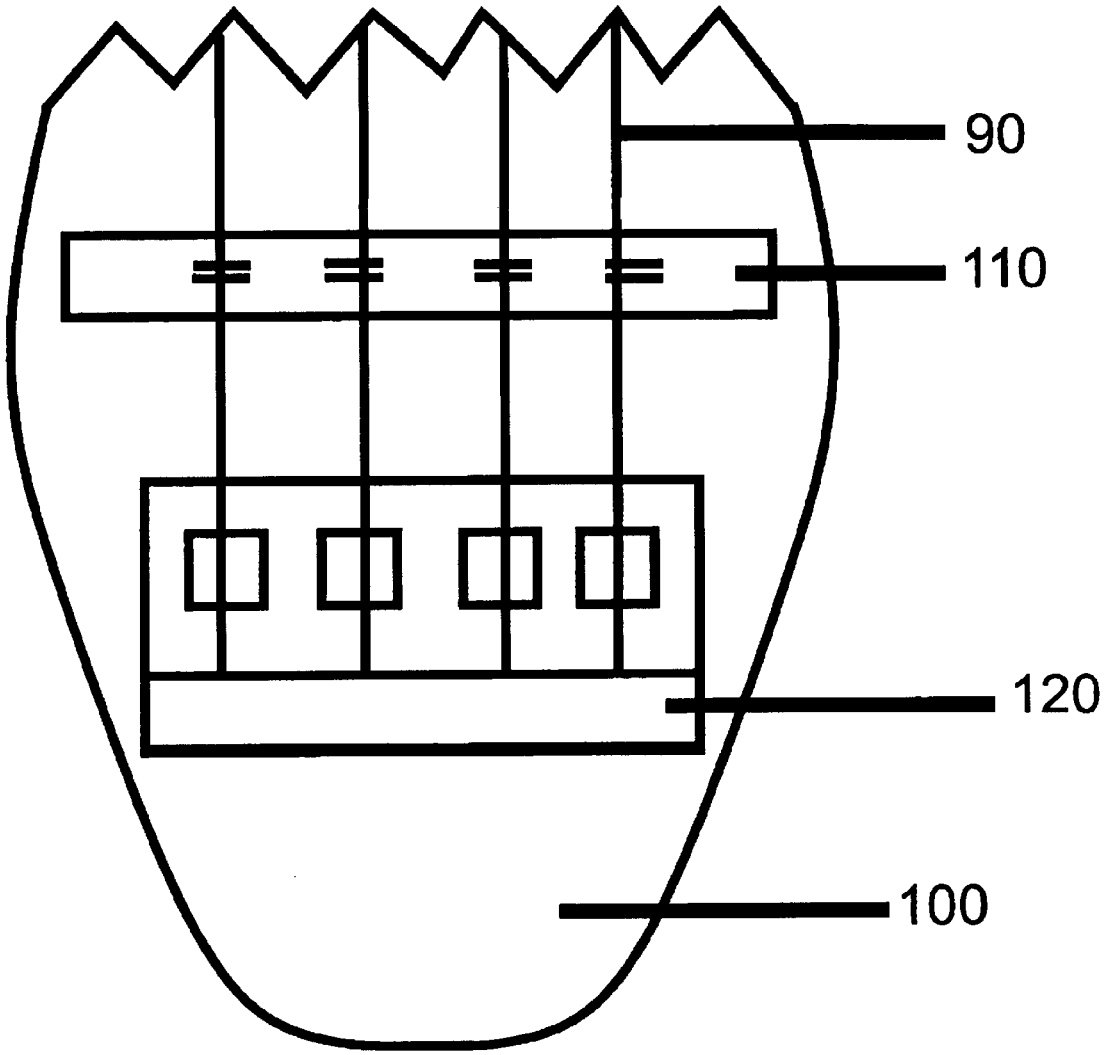
FIG. 5 illustrates a portion of the front view detailing the body, bridge, pickup, and strings.

FIG. 5 shows a portion of the front view of the present invention detailing the attachment of pickup 110 and bridge 120 to body 100. Pickup 110 may be a divided pickup. Strings 90 pass longitudinally over pickup 110 and are affixed to bridge 120.

Figure 6:
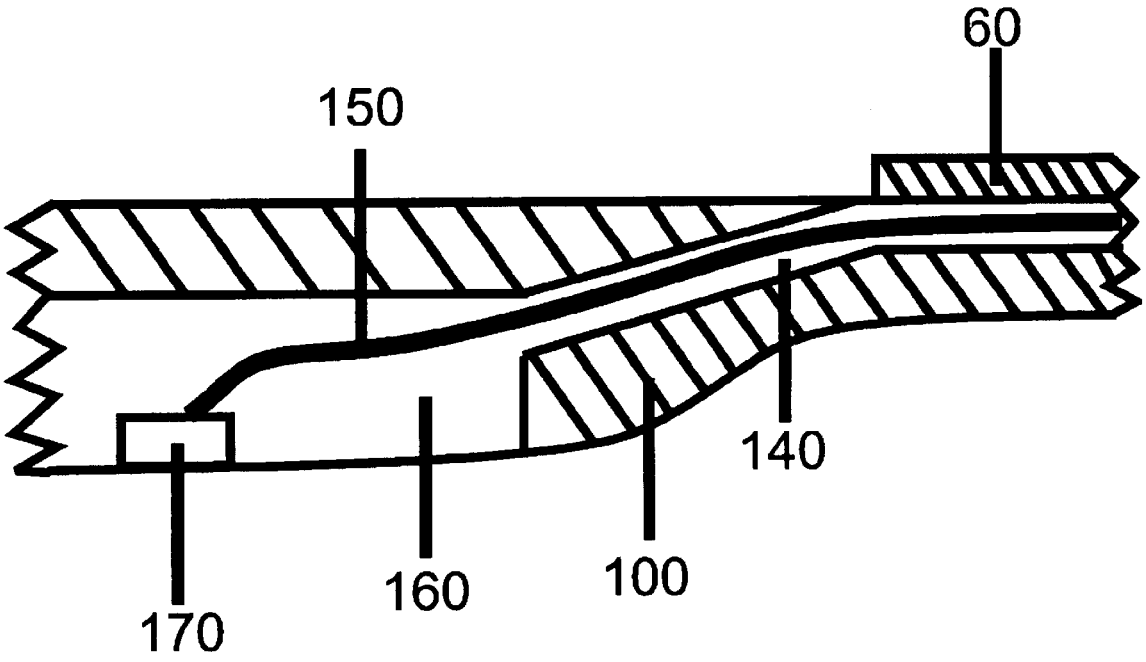
FIG. 6 illustrates a portion of the side view detailing the body, fret board, and port.

FIG. 6 shows a portion of the side view of body 100. Compartment 160 is embedded in the back of body 100. Channel 140 traverses from the front of body 100 to compartment. Port 170 attaches to compartment 160. The other end of wiring 150 connects to port 170. Port 170 may consist of any of a variety of connection means such as pin connectors, jacks, plugs, wireless transmitters, enabling said port 170 to serve as an interface to other equipment such as processors or computers.

OPERATION

The player operates the instrument of the present invention by pressing one or more strings 90 down unto fret board 60. Pickup 110 converts the vibrating strings 90 of the fretted note to a signal, which is sent via wiring 150 to port 170. Coinciding with the location of the player's pressing, one or more trigger pads (fret trigger pad 50, finger trigger pad 70, percussion trigger pad 80) sends a signal via wiring 150 to port 170. During the time movement, the player can combine the above action with further action by the players other hand. Anywhere between the fretted note and bridge 120, strings 90 may be struck, strummed, slapped, popped, picked, or played with a bow. The player will find that each method will create different overall sounds. Depending how and where the strings 90 is played with the other hand, the player can strike a second trigger pad (fret trigger pad 50, finger trigger pad 70, percussion trigger pad 80), typically on the lower portion of fret board 60. This causes a third event within the time movement, which is a second trigger signal. With this ability, the player then can create compositions integrating many movements with a plurality of signals per time movement. Using current outboard technology, the player is able to assign one of thousands of sounds to each of the strings 90 and each of the trigger pads (fret trigger pad 50, finger trigger pad 70, percussion trigger pad 80).

DESCRIPTION AND OPERATION—ALTERNATIVE EMBODIMENTS

The instrument of the present invention may be manufactured or used with any combination or number of fret trigger pads 50, finger trigger pads 70, or percussion trigger pads 80. An instrument may have only fret trigger pads 50 and finger trigger pads 70. An instrument may have only fret trigger pads 50 and percussion trigger pads 80. An instrument may have only finger trigger pads 70 and percussion trigger pads 80. An instrument may have only fret trigger pads 50. An instrument may have only finger trigger pads 70. An instrument may have only percussion trigger pads 80. This may be accomplished through the manufacture of interchangeable fret boards 60 having the desired presence or absence of positions for trigger pads. This may also be accomplished by having the desired number of trigger pads (fret trigger pad 50, finger trigger pad 70, percussion trigger pad 80) installed in, or removed from, fret board 60.

The instrument of the present invention may be manufactured such that fret board 60 is detachable and interchangeable to allow for variations in the style or composition of the fret board 60 or for the style or composition of the trigger pads (fret trigger pad 50, finger trigger pad 70, percussion trigger pad 80).

The instrument of the present invention may be manufactured such that the trigger pads (fret trigger pad 50, finger trigger pad 70, percussion trigger pad 80) may be easily inserted, removed, or replaced.

The instrument of the present invention may be manufactured such that head stock 10, neck 130, and body 100 are a single component of material.

In the instrument of the present invention, body 100 may also be composed of a plurality of materials of different composition, arranged longitudinally parallel to strings 90 such that a particular string 90 vibrates over one composition of material while another string 90 vibrates over a different composition of material. The subtle effects on the vibration of strings 90 will be converted to a signal by pickup 110.

The instrument of the present invention may be manufactured such that percussion trigger pads 80 are not located in any particular fret position.

The instrument of the present invention may be manufactured such that fret trigger pads 50 are located at fret positions corresponding to specific tones produced by strings 90.

The instrument of the present invention may be manufactured such that percussion trigger pads 80 may be pressed without strumming or pressing strings 90.

The instrument of the present invention may be manufactured such that the cut out edge for a trigger pad on fret board 60 acts as a fret. This enables the instrument to be played as either a fretless or as a fretted instrument.

SUMMARY, RAMIFICATIONS, AND SCOPE

The instrument of the present invention is advancement in sound generation. This instrument is specifically designed to integrate current sound trigger technology to meet the growing demands of current and future electronic music. In an ever more complicated beat and tone structure, modern music of all genres requires multitasking instruments that are able to interface with multiple mediums. To increase versatility, this integrated sound trigger musical instrument can be played upright or lying horizontally. When produced in a lightweight and small package, the instrument can even be worn by a strap over the shoulder and played like a guitar. The design does not require a specific number of strings or trigger pads. Practical designer limits are governed by the amount of playing surface available due to scale length and neck width. While the instrument of the present invention is designed as an advanced module to interface with a computer, it is entirely possible for the instrument to contain a computer tone generator inside the body of the instrument. In this configuration, the instrument becomes an extremely portable article of entertainment and amusement.

Interchangeable fret boards create expanded consumer choice and choice marketing opportunities. Entry level, inexpensive instruments can be sold with a limited number of trigger pads. Consumers can add trigger pads or upgrade fret boards as their skill level grows and as their budget allows. Specialist performers may evolve, demanding fret boards with particular trigger pad configurations.

Removable trigger pads also allow for replacement of defective trigger pads and also for experimentation with trigger pads having different response to suit the player's desire. Musicians can start with a minimum number of trigger pads and purchase more as their budget allows.

The instrument can be played using a fret board that allows for both fretless and fretted playing. This unique dual-mode of performance is possible by taking advantage of the cut out edge for a trigger pad on the fret board. The cut out edge acts as a fret for the string when fretted play is desired. Fretless play is accomplished by not using the cut out edge.

The instrument solves a long-standing problem with band economy. Using this instrument, a single bass player is now able to play the rhythm section of the band. Smaller bands can provide more elaborate music at less expense or greater income per band member. Such a band has a competitive edge over more traditional bands, especially at small audience venues, such as coffee shops, where available stage space and amount of pay may be limited. For large audience venues, the instrument offers band distinction and opportunity for audience recognition for superior performance using the instrument.

Although the description above contains many specifications, these should not be construed as limiting the scope of the invention but as merely providing illustrations of some of the presently preferred embodiments of this present invention. Persons skilled in the art will understand that the method and apes described herein may be practiced, including but not limited to, the embodiments described. Further, it should be understood that the invention is not to be unduly limited to the foregoing which has been set forth for illustrative purposes. Various modifications and alternatives will be apparent to those skilled in the art without departing from the true scope of the invention, as defined in the following claims. While there has been illustrated and described particular embodiments of the present invention, it will be appreciated that numerous changes and modifications will occur to those skilled in the art, and it is intended in the appended claims to cover those changes and modifications which fall within the true spirit and scope of the present invention.

thus, the scope of the invention should be determined by the appended claims and their legal equivalents, rather than by the examples given.

What is claimed is:

1. A method for producing a plurality of simultaneous sounds in a single time movement, the method comprising:

(a) depressing a string unto a fret board;

(b) simultaneously actuating a trigger pad attached to said fret board, whereby a trigger pad signal is produced;

(c) actuating said string, thereby producing an acoustic signal;

(d) collecting said acoustic signal, thereby producing a pickup signal;

(e) assigning a sound to said trigger pad signal; and (f) combining said sound and said pickup signal.

2. The method of claim 1, wherein said string actuation comprises selecting at least one act from a list of acts comprising: i) striking, ii) strumming, iii) slapping, iv) popping, v) picking, vi) playing with a bow.

3. The method of claim 1, further comprising the step of:

(a) actuating a plurality of said trigger pads, whereby a plurality of events in said time movement is produced.

4. The method of claim 1, further comprising the steps of:

(a) producing bass sounds using said strings; and (b) assigning rhythm sounds to said trigger pads.

5. A device for controlling electrical and acoustical signals comprising:

(a) a body;

(b) a neck with a proximate end attached to and extending from the border of said body;

(c) a head stock attached to the opposite end of said neck;

(d) a tuning machine bracket attached to front of said head stock;

(e) a plurality of tuning machines attached to said tuning machine bracket;

(f) a slotted guide attached to front of said head stock;

(g) a fret board attached to front of said neck, wherein said fret board further comprises detachment means whereby said fret board may be changed with an alternate fret board;

(h) a plurality of trigger pads attached to said fret board;

(i) a pickup attached to front of said body;

(j) a bridge attached to front of said body;

(k) one end of a string affixed to each said tuning machine;

(l) the opposite end of said string affixed to said bridge;

(m) a first connection means from said trigger pads, whereby signals may be transferred from said device; and (n) a second connection means from said pickup, whereby signals may be transferred from said device.

6. The device of claim 5, wherein said body, said neck, and said head stock are one integrated piece.

7. The device of claim 5, wherein said tuning bracket is integrated into said head stock.

8. The device of claim 5, wherein said trigger pads comprise fret trigger pads.

9. The device of claim 8, wherein said fret trigger pads are located at locations along said fret board corresponding to specific tones produced by said strings.

10. The device of claim 8, wherein said fret trigger pads are located at arbitrary locations along said fret board.

11. The device of claim 5, wherein said trigger pads comprise percussion trigger pads.

12. The device of claim 5, wherein said trigger pads comprise finger trigger pads.

13. The device of claim 5, wherein said pickup is a divided pickup.

14. The device of claim 5, wherein said body is comprised of a plurality of materials of different composition, arranged longitudinally parallel to the axis of said strings, whereby a particular said string vibrates proximately to a particular composition of said material.

15. The device of claim 5, wherein said trigger pads are located at locations along said fret board corresponding to specific tones produced by said strings.

16. The device of claim 5, wherein said trigger pads further comprise trigger pads, which may be actuated without actuating said strings.

17. The device of claim 5, wherein said fret board further comprises fretting means at the location of said trigger pad.

18. The device of claim 5, wherein said first connection means further comprises a computer tone generator.

19. The device of claim 5, wherein said second connection means further comprises a computer tone generator.

20. A device for controlling electrical and acoustical signals comprising:

(a) a body;

(b) a neck with a proximate end attached to and extending from the border of said body;

(c) a head stock attached to the opposite end of said neck;

(d) a tuning machine bracket attached to front of said head stock;

(e) a plurality of tuning machines attached to said tuning machine bracket;

(f) a slotted guide attached to front of said head stock;

(g) a fret board attached to front of said neck;

(h) a plurality of trigger pads attached to said fret board, wherein said trigger pads further comprise detachment means whereby said trigger pads may be changed with alternate trigger pads;

(i) a pickup attached to front of said body;

(j) a bridge attached to front of said body;

(k) one end of a string affixed to each said tuning machine;

(l) the opposite end of said string affixed to said bridge;

(m) a first connection means from said trigger pads, whereby signals may be transferred from said device; and (n) a second connection means from said pickup, whereby signals may be transferred from said device.

21. The device of claim 20, wherein said body, said neck, and said head stock are one integrated piece.

22. The device of claim 20, wherein said tuning bracket is integrated into said head stock.

23. The device of claim 20, wherein said fret board is integrated into said neck.

24. The device of claim 20, wherein said trigger pads comprise fret trigger pads.

25. The device of claim 24, wherein said fret trigger pads are located at locations along said fret board corresponding to specific tones produced by said strings.

26. The device of claim 24, wherein said fret trigger pads are located at arbitrary locations along said fret board.

27. The device of claim 20, wherein said trigger pads comprise percussion trigger pads.

28. The device of claim 20, wherein said trigger pads comprise finger trigger pads.

29. The device of claim 20, wherein said pickup is a divided pickup.

30. The device of claim 20, wherein said body is comprised of a plurality of materials of different composition, arranged longitudinally parallel to the axis of said strings, whereby a particular said string vibrates proximately to a particular composition of said material.

31. The device of claim 20, wherein said trigger pads are located at locations along said fret board corresponding to specific tones produced by said strings.

32. The device of claim 20, wherein said trigger pads further comprise trigger pads, which may be actuated without actuating said strings.

33. The device of claim 20, wherein said fret board further comprises fretting means at the location of said trigger pad.

34. The device of claim 20, wherein said first connection means further comprises a computer tone generator.

35. The device of claim 20, wherein said second connection means further comprises a computer tone generator.

* * * * *

UNITED STATES PATENT AND TRADEMARK OFFICE

CERTIFICATE OF CORRECTION

PATENT NO. : 6,777,608 B1
DATED : August 17, 2004
INVENTOR(S) : Travis Redding

It is certified that error appears in the above-identified patent and that said Letters Patent is hereby corrected as shown below:

Column 1,
Line 26, please change “string For” to -- string. For --.
Line 41, please change “playing surface to points” to -- playing surface points --.
Line 57, please change “pluck Corrigan” to -- pluck. Corrigan --.

Column 2,
Line 47, please change “pitch, rater” to -- pitch, rather --.
Line 61, please change “inventors anticipated” to -- inventor’s anticipated --.

Column 4,
Line 30, please change “by the players” to -- by the player’s --.

Column 6,
Line 20, please change “apes” to -- apparatus --.
Line 34, please change “thus,” to -- Thus, --.

Signed and Sealed this

Fourteenth Day of December, 2004

JON W. DUDAS
*Director of the United States Patent and Trademark Office*